US010207908B2

(12) United States Patent
Parker

(10) Patent No.: US 10,207,908 B2
(45) Date of Patent: Feb. 19, 2019

(54) AUTOMATIC WAX DIPPING SYSTEM

(71) Applicant: Evan Parker, Ipswich, MA (US)

(72) Inventor: Evan Parker, Ipswich, MA (US)

( * ) Notice: Subject to any disclaimer, the term of this patent is extended or adjusted under 35 U.S.C. 154(b) by 0 days.

(21) Appl. No.: 15/602,053

(22) Filed: May 22, 2017

(65) Prior Publication Data

US 2017/0334700 A1 Nov. 23, 2017

Related U.S. Application Data

(60) Provisional application No. 62/339,273, filed on May 20, 2016.

(51) Int. Cl.

| | |
|---|---|
| ***B67B 5/05*** | (2006.01) |
| ***B22C 23/02*** | (2006.01) |
| ***B65D 39/00*** | (2006.01) |
| ***B05C 3/10*** | (2006.01) |
| *B67B 5/00* | (2006.01) |

(52) U.S. Cl.

CPC ..... *B67B 5/05* (2013.01); *B05C 3/10* (2013.01); *B22C 23/02* (2013.01); *B65D 39/0005* (2013.01); *B65D 39/00* (2013.01); *B67B 5/00* (2013.01)

(58) Field of Classification Search

CPC ..... B05C 13/025; B05C 3/10; B65G 49/025; B65G 49/05; B67B 5/00; B67B 5/05; B22C 23/02; B65D 39/00; B65D 39/0005; Y10S 118/03; Y10S 118/06; B31B 50/75; B31B 50/745; B05D 1/18

USPC ..... 118/429

See application file for complete search history.

(56) References Cited

U.S. PATENT DOCUMENTS 1,042,914 A * 10/1912 Heyl ..... B05O 3/10 118/426
1,395,258 A * 11/1921 Clark ..... B31B 50/00 118/428
2,023,822 A * 12/1935 Arnott ..... B05C 3/10 118/426

* cited by examiner

*Primary Examiner* — Laura Edwards

(57) ABSTRACT

An automatic wax dipping system is an apparatus that dips multiple bottles into wax without the manual input of a user. The apparatus includes a basin, a first receptacle, a second receptacle, a first set of heating elements, a track mechanism, and a motorized belt. The basin upholds components of the apparatus. The first receptacle houses oil and the second receptacle houses wax. The first set of heating elements heat the oil which in turn heats the wax. The track mechanism includes a plurality of rails and an at least one motorized belt. The plurality of rails upholds multiple bottles and directs the path of multiple bottles across the present invention. The at least one motorized belt forces the multiple bottles through the plurality of rails in specific lengthwise sections where the multiple bottles may require additional force.

20 Claims, 6 Drawing Sheets

AUTOMATIC WAX DIPPING SYSTEM

The current application claims a priority to the U.S. Provisional Patent application Ser. No. 62/339,273 filed on May 20, 2016. The current application is filed on May 22, 2017 while May 20, 2017 was on a weekend.

FIELD OF THE INVENTION

The present invention relates generally to automatic wax dipping system. More specifically, the present invention is an automatic wax dipping system that seals and protects the contents within a bottle.

BACKGROUND OF THE INVENTION

The sealing of bottles prevents liquid or other contents from spilling out in unwanted circumstances. Additionally, seals prevent harmful bacteria from entering the bottle, while also providing aesthetic looks through the incorporation of different shapes, colors, and artistic designs. One such type of seal is that of the wax type, which is heated to a liquid form before bottle necks are dipped into wax. There are various techniques used which allow for the application of wax onto bottle necks with non-drip style seals, however, such methods generally require the use of human interaction which result in human error and more mess.

It is therefore an objective of the present invention to introduce an automatic wax dipping system for bottles. The system is an automated and hands free in-line wax dipping system configured to apply a non-drip design wax seal to the neck of any type of glass bottle by inverting the bottle upside down and passing the bottle neck through a specific chemically formulated type of hot wax. Utilization of the present invention provides a tamper-proof seal on glass bottles which satisfy the legal requirements that allow for safe consumer purchasing. The present invention can be used as a stand-alone wax dipping system or can be integrated into a full bottling line. The system works for any bottle application, evenly dipping bottles into wax and does not require a tare tab, as the wax is specifically formulated to allow for twist off. The system allows full fluid filled bottles of any kind to be wax dipped to a specific desired height on the bottle neck. The system will be adjustable to fit any bottle needs as long as the fluid inside is completely leak proof sealed with either a cork, cap, or other sealing means that the bottle may require. Use of the present invention is practical, safe, and effective, as it eliminates many man hours of hand wax dipping.

DETAILED DESCRIPTIONS OF THE INVENTION

All illustrations of the drawings are for the purpose of describing selected versions of the present invention and are not intended to limit the scope of the present invention.

Figure 1:
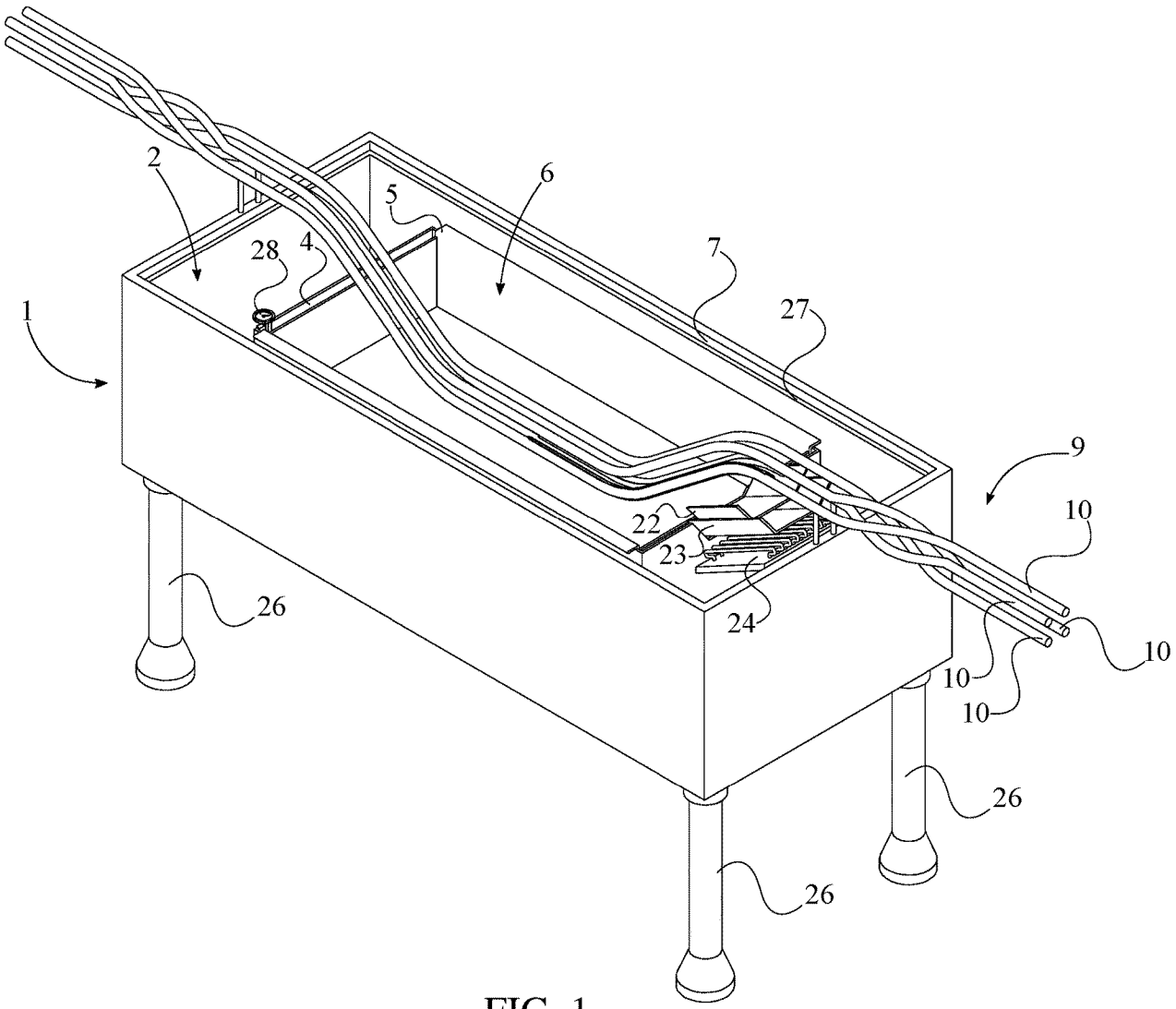
FIG. 1 is a perspective view of the preferred embodiment of the present invention.
Figure 3:
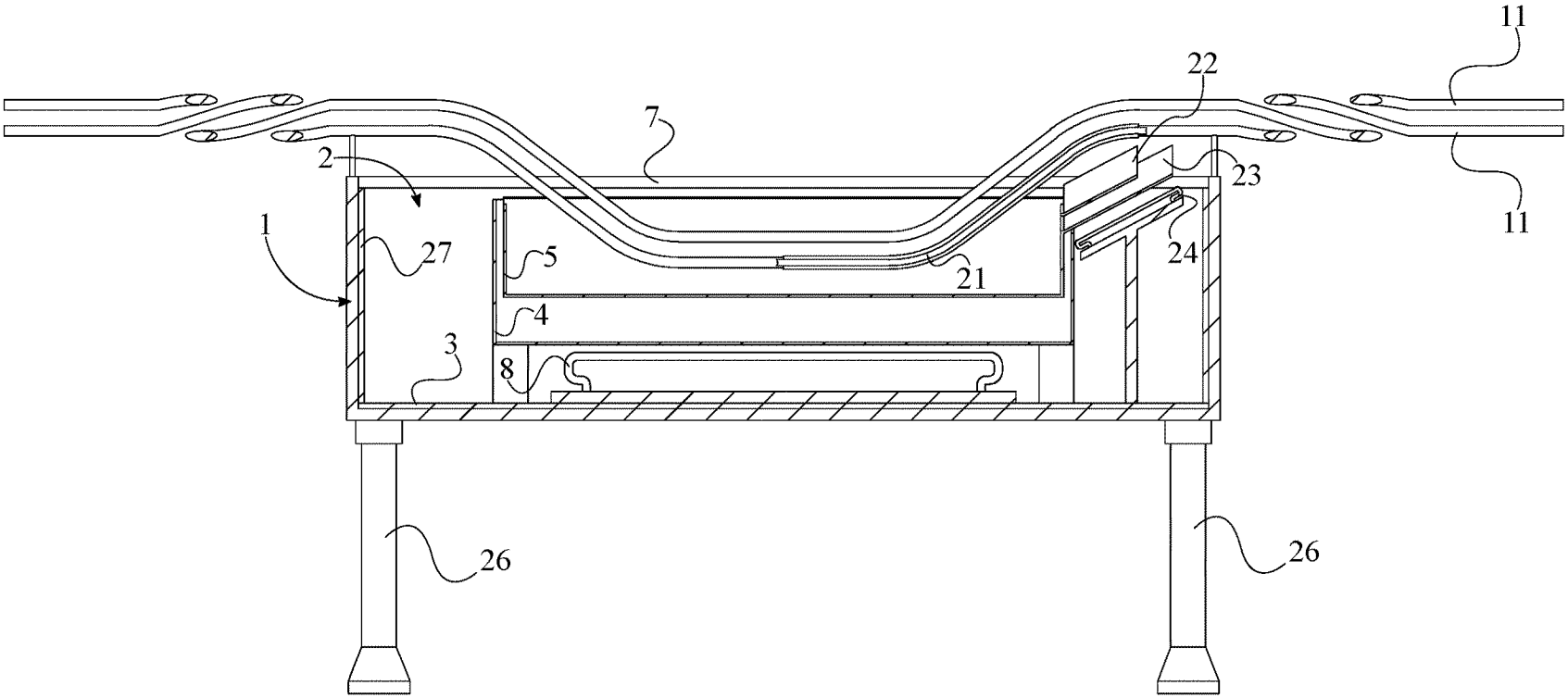
FIG. 3 is a cross-sectional view of FIG. 2 along line 3-3 of the preferred embodiment of the present invention.

The present invention is an automatic wax dipping system that uniformly seals multiple bottles. The present invention seals multiple bottles without the need for manual guidance from a user. As shown in FIG. 1 and FIG. 3, the present invention comprises a basin 1, a first receptacle 4, a second receptacle 5, a first set of heating elements 8, and a track mechanism 9. The basin 1 upholds the first receptacle 4, the second receptacle 5, the first set of heating elements 8, and the track mechanism 9. The first receptacle 4 contains a quantity of oil, and the second receptacle 5 contains a quantity of liquid wax. The first set of heating elements 8 heats the oil within the first receptacle 4 which consequently heats the wax within the second receptacle 5. The track mechanism 9 directs multiple bottles across the present invention. The track mechanism 9 comprises a plurality of rails 10 and at least one motorized belt 21. The plurality of rails 10 defines the path of multiple bottles into the basin 1, through the wax within the second receptacle 5, and out of the basin 1. The plurality of rails 10 comprises at least one first rail 11 and at least one second rail 12. The at least one first rail 11 and the at least one second rail 12 upholds and secures multiple bottles as each bottle traverses across the present invention and is dipped into the wax. The at least one motorized belt 21 drives multiple bottles through the plurality of rails 10.

Figure 2:
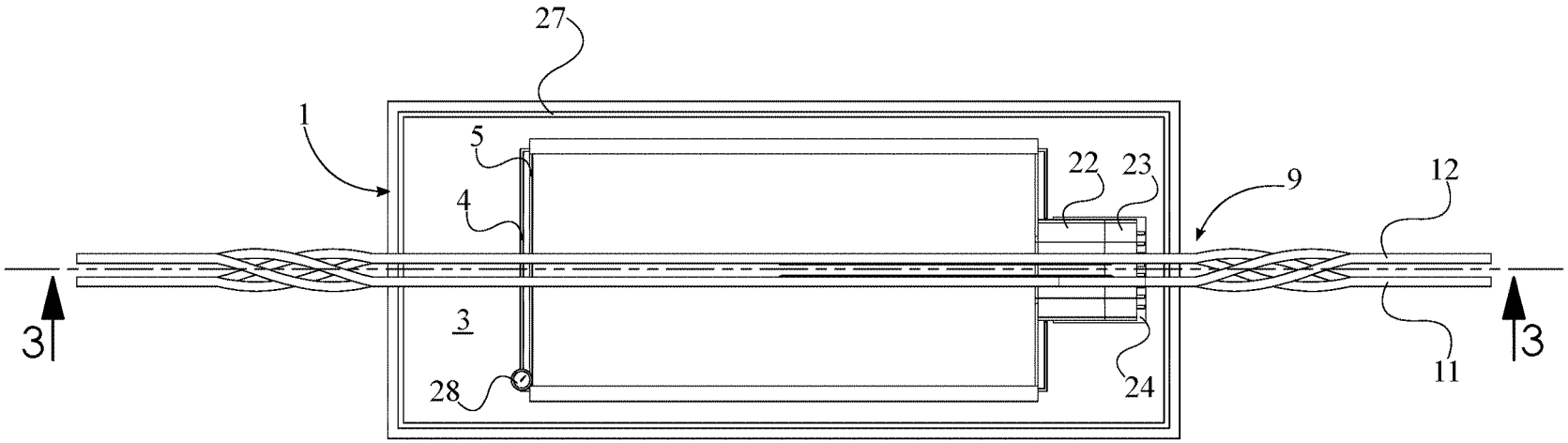
FIG. 2 is a top side view of the preferred embodiment of the present invention.

The overall configuration of the aforementioned components evenly dips multiple bottles through the heated quantity of liquid wax within the second receptacle 5. The first receptacle 4 and the first set of heating elements 8 are mounted within the basin 1 as to uphold and contain both the first receptacle 4 and the first set of heating elements 8, as seen in FIG. 3. The basin 1 allows the first set of heating elements 8 to heat the oil within the first receptacle 4 without damaging any nearby objects or surfaces. The first set of heating elements 8 is in thermal communication with the first receptacle 4 in order to heat the oil within the first receptacle 4. The second receptacle 5 is mounted within the first receptacle 4 so that the heated oil inadvertently heats the wax within the second receptacle 5. The plurality of rails 10 is mounted adjacent to the basin 1 and is suspended across an opening 2 of the basin 1, as illustrated in FIG. 2 and FIG. 3. This arrangement allows multiple bottles to traverse across both the basin 1 and the second receptacle 5. In order to brace each bottle from opposing sides and to guide each bottle along the plurality of rails 10, the at least one first rail 11 and the at least one second rail 12 are parallel and offset to each other. In order for the multiple bottles to be removed from the wax contained within the second receptacle 5, without the user manually removing the bottles, the at least one motorized belt 21 is operatively integrated into a specific lengthwise section of the plurality of rails 13. The specific lengthwise section of the plurality of rails 13 is the section of the plurality of rails 10 that require additional force to maneuver the multiple bottles through the plurality of rails 10. The at least one motorized belt 21 is used to assist in transporting a bottle along the plurality of rails 10.

Figure 4:
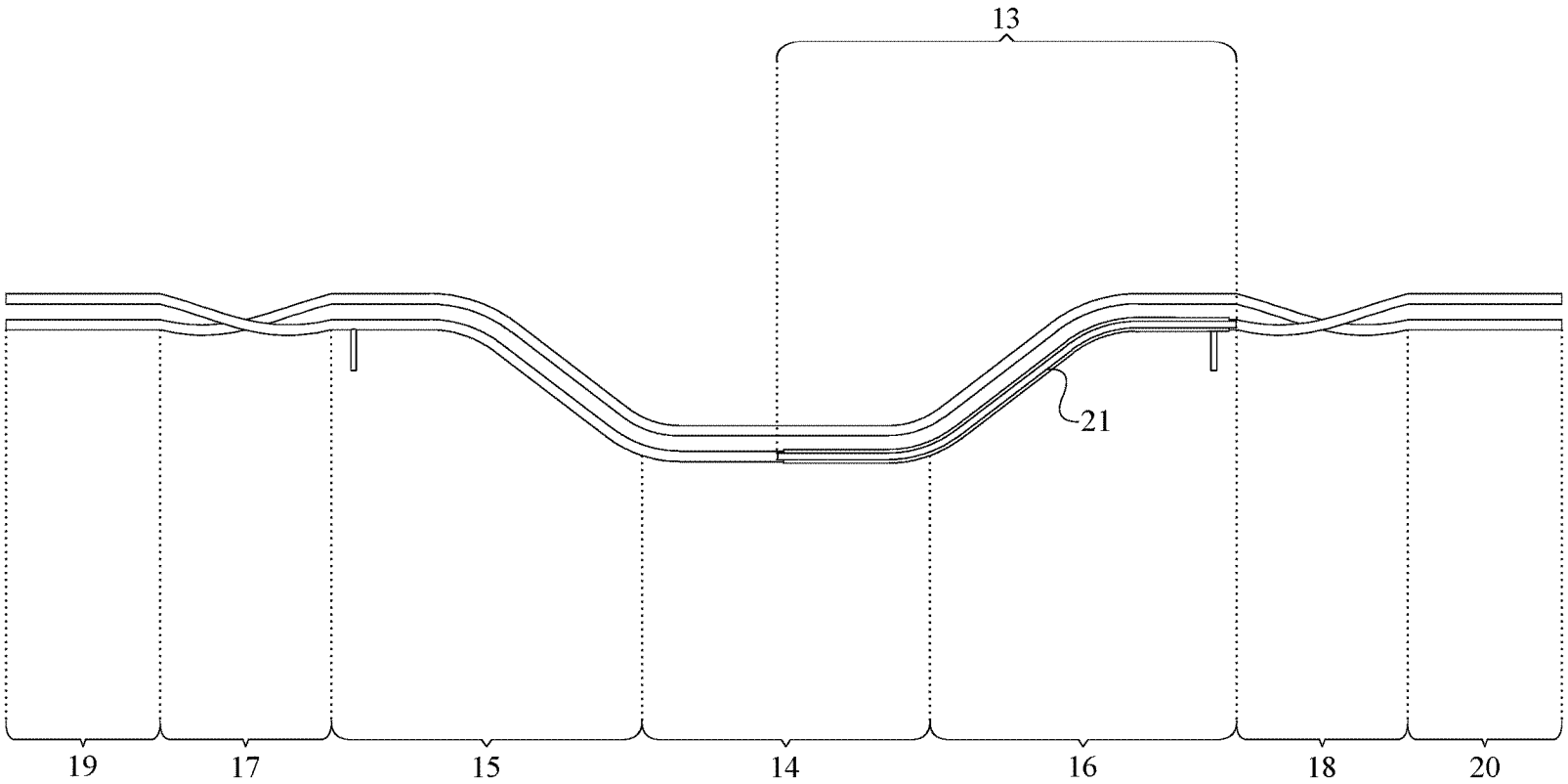
FIG. 4 is a schematic view of the track mechanism of the present invention.

In order for the plurality of rails 10 to direct the path of multiple bottles across the present invention without having a user manually insert the bottle into the heated wax within the second receptacle 5, each of the plurality of rails 10 comprises a dipping portion 14, a descending portion 15, an ascending portion 16, a first inverting portion 17, a second inverting portion 18, an entering portion 19 and an exiting portion 20, as shown in FIG. 4. The dipping portion 14 defines the path of multiple bottles across the second receptacle 5 and positions multiple bottles at a specific height within the second receptacle 5. The descending portion 15 defines the path of multiple bottles into the second receptacle 5, and the ascending portion 16 defines the path of multiple bottles out of the second receptacle 5. The first inverting portion 17 flips the multiple bottles upside down so that the desired ends of the multiple bottles come into contact with the wax within the second receptacle 5, before traversing into the basin 1 through the descending portion 15. The second inverting portion 18 flips the bottles upright, once having passed through the second container and out of the basin 1 through the ascending portion 16. The entering portion 19 receives the multiple bottles, and the exiting portion 20 releases the multiple bottles that have traversed across the present invention.

The configuration of each portion of each of the plurality of rails 10 allows for the unhindered passage of multiple bottles through the plurality of rails 10. In the preferred embodiment of the present invention, the plurality of rails 10 comprises a linear structure from the entering portion 19 to the exiting portion 20, as shown in FIG. 2 and FIG. 4. The descending portion 15 is positioned adjacent to the dipping portion 14, and the ascending portion 16 is positioned adjacent to the dipping portion 14, opposite to the descending portion 15. This arrangement allows a bottle to enter into the basin 1, traverse across the second receptacle 5, and out of the basin 1 due to gravitational force in the descent and momentum in the ascent. The first inverting portion 17 is positioned adjacent to the descending portion 15, opposite to the dipping portion 14, in order for the bottle to be flipped upside down thereby correctly orienting the bottles and accelerating the bottles through the plurality of rails 10. The entering portion 19 is positioned adjacent to the first inverting portion 17, opposite the descending portion 15, so that the bottles are readily received within the plurality of rails 10. The second inverting portion 18 is positioned adjacent to the ascending portion 16, opposite to the dipping portion 14, in order to flip the bottle upright before the bottle exits the plurality of rails 10. In the preferred embodiment of the present invention, the specific lengthwise section is the dipping portion 14 and the ascending portion 16 as the momentum of the bottles is decreased by the wax within the second receptacle 5. The exiting portion 20 is positioned adjacent to the second inverting portion 18, opposite to the ascending portion 16, so the bottles are guided out of the grasp of the plurality of rails 10. In an alternate embodiment of the present invention, the plurality of rails 10 comprises a U-shaped structure from the entering portion 19 to the exiting portion 20. More specifically, the dipping portion 14 of this alternate embodiment is curved, and the ascending portion 16 is oriented in the same direction as the descending portion 15.

The arrangement of each of the portions guides a continuous path for the multiple bottles into the basin 1, across the second receptacle 5, and out of the basin 1. More specifically, the descending portion 15 traverses into an opening 6 of the second receptacle 5 as the second receptacle 5 is resting within the basin 1 and is lower than the opening 6 of the second receptacle 5. This arrangement is shown in the cross-sectional view of FIG. 3. The dipping portion 14 traverses across the opening 6 of the second receptacle 5 in order for the bottle to be dipped into the wax within the second receptacle 5. The ascending portion 16 traverses out of the opening 6 of the second receptacle 5 in order for the bottle to exit past the basin 1. As the bottle traverses across the ascending portion 16, the hot wax has not yet dried. In order to prevent any wax from being wasted and from creating a mess, the preferred embodiment of the present invention comprises a drip-catching trough 22. The drip-catching trough 22 is connected adjacent to the second receptacle 5 as to direct any excess wax back into the second receptacle 5. More specifically, the drip-catching trough 22 is positioned offset and along the ascending portion 16 as bottle traverses the ascending portion 16 following the dipping portion 14 of the plurality of rails 10.

Figure 6:
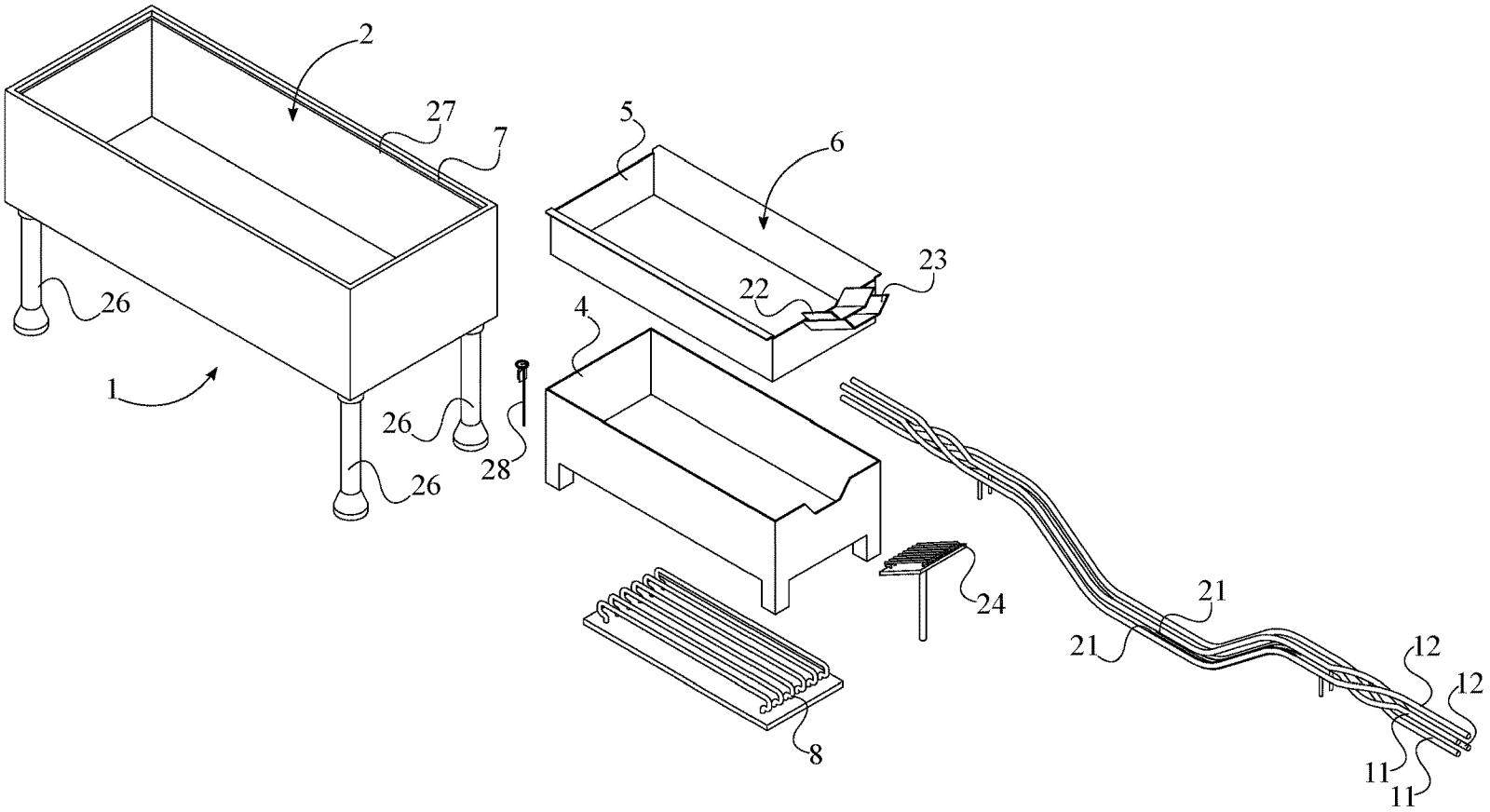
FIG. 6 is an exploded view of the preferred embodiment of the present invention.

In the preferred embodiment of the present invention, a wax-refilling trough 23 allows the second receptacle 5 to be refilled while the present invention is in use, as illustrated in FIG. 3 and FIG. 6. The wax-refilling trough 23 is connected adjacent to the second receptacle 5 and is peripherally positioned to an opening 7 of the second receptacle 5. This allows the user to refill the second receptacle 5 without pouring wax into the opening 6 of the second receptacle 5 that is adjacent to the path of the bottles along the plurality of rails 10, thereby reducing or eliminating any mess. A second set of heating elements 25 aids in the heating of newly added wax into the second receptacle 5. The second set of heating elements 25 is mounted adjacent to the second receptacle 5 and is in thermal communication with the wax-refilling trough 23. This arrangement allows the wax entering the second receptacle 5 via the wax-refilling trough 23 to be heated upon entry into the second receptacle 5.

Figure 5:
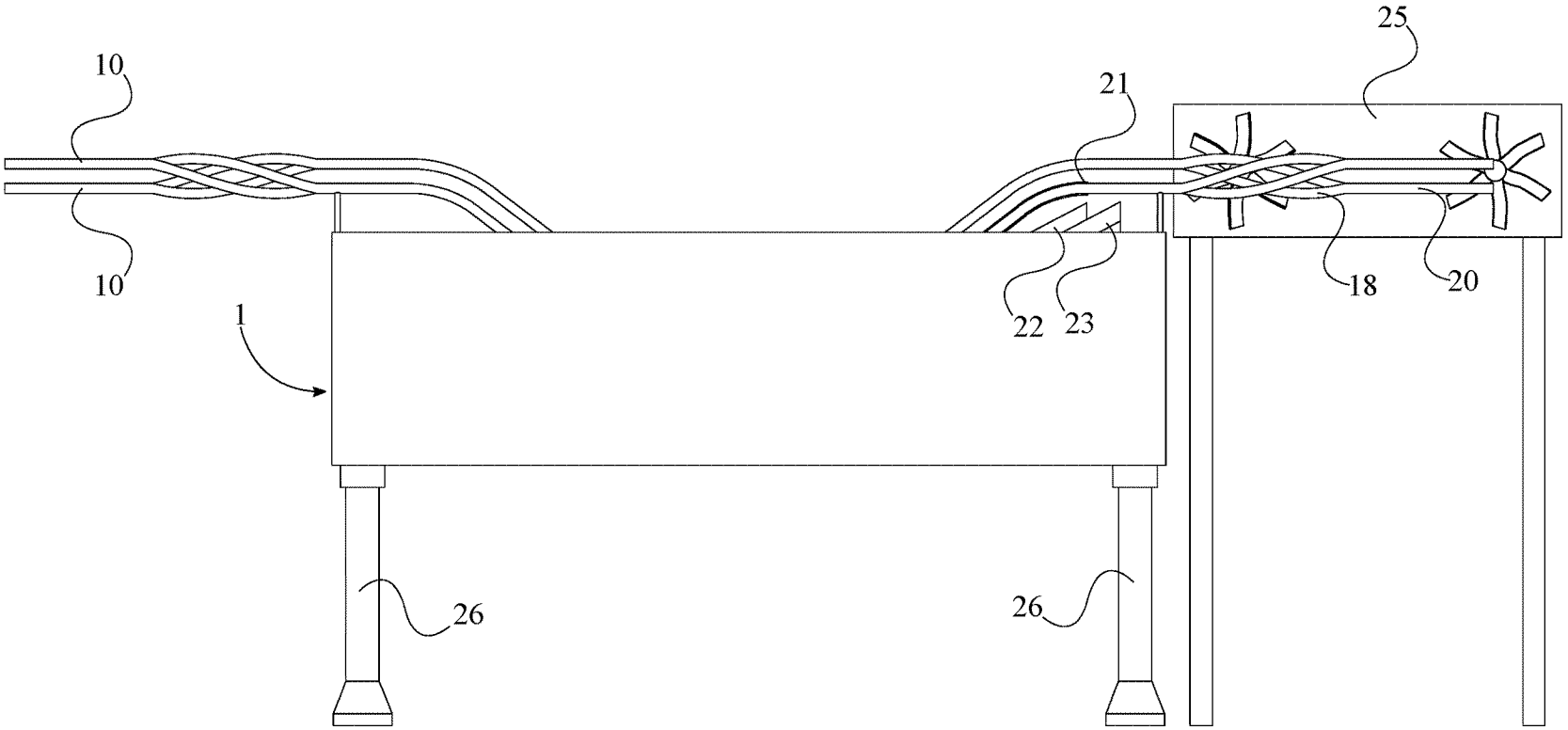
FIG. 5 is a front side view of the preferred embodiment of the present invention, including the cooling mechanism.

The preferred embodiment of the present invention further comprises a cooling mechanism 25, as shown in FIG. 5. The cooling mechanism 25 facilitates the drying process of the wax around the multiple bottles that exit the plurality of rails 10, thereby sealing each of the bottles. In order to effectively dry the wax around the bottles, the cooling mechanism 25 is mounted adjacent and offset from the plurality of rails 10 and is in thermal communication with the second inverting portion 18 and the exiting portion 20.

An embodiment of the present invention comprises plurality of legs 26 that elevate the basin 1. The plurality of legs 26 further distances the hot wax and hot oil, that are upheld by the basin 1, from surrounding objects and surfaces, as seen in FIG. 1, FIG. 3, FIG. 5, and FIG. 6. The plurality of legs 26 is positioned external to the basin 1 and is connected normal to a base 3 of the basin 1 so as to raise the basin 1. Furthermore, the plurality of legs 26 is peripherally positioned about the base 3 of the basin 1 as to structurally support the basin 1 and the components that are upheld by the basin 1.

Another embodiment of the present invention comprises a thermally-insulative layer 27, seen in FIG. 1, FIG. 2, FIG. 3, and FIG. 6. The thermally-insulative layer 27 reduces the transfer of heat from the first receptacle 4 and the second receptacle 5 to the surrounding environment. The thermally-insulative layer 27 is superimposed onto an internal surface 7 of the basin 1 as the basin 1 surround both the first receptacle 4 and the second receptacle 5 and contains the first set of heating elements 8. In the same embodiment of the present invention, a temperature-measuring gauge 28 provides the current temperature of the hot oil so that a user may vary the temperature of the first set of heating elements 8. The user knows how much to increase or decrease the temperature of the first set of heating elements 8 based on the current temperature reading of the hot oil in order to heat the hot wax accordingly. The temperature-measuring gauge 28 is in thermal communication with the first receptacle 4 as the first set of heating elements 8 is in thermal communication with the first receptacle 4.

Although the invention has been explained in relation to its preferred embodiment, it is to be understood that many other possible modifications and variations can be made without departing from the spirit and scope of the invention as hereinafter claimed.

What is claimed is:

1. An automatic wax dipping system comprising:
a basin;
a first receptacle;
a second receptacle;
a first set of heating elements;
a track mechanism;
a quantity of liquid wax;
the track mechanism comprising a plurality of rails and at least one motorized belt;
the plurality of rails comprising at least one first rail and at least one second rail;
the first receptacle and the first set of heating elements being mounted within the basin;
the first set of heating elements being in thermal communication with the first receptacle;
the second receptacle being mounted within the first receptacle;
the quantity of liquid wax being accommodated within the second receptacle;
the plurality of rails being mounted adjacent to the basin;
the plurality of rails being suspended across an opening of the basin;
the at least one first rail and the at least one second rail being parallel and offset to each other; and
the at least one motorized belt being operatively integrated into a specific lengthwise section of the plurality of rails.

2. The automatic wax dipping system as claimed in claim 1 comprising:
each of the plurality of rails comprising a dipping portion, a descending portion, an ascending portion, a first inverting portion, a second inverting portion, an entering portion, and an exiting portion;
the descending portion being positioned adjacent to the dipping portion;
the ascending portion being positioned adjacent to the dipping portion, opposite to the descending portion;
the first inverting portion being positioned adjacent to the descending portion, opposite to the dipping portion;
the entering portion being positioned adjacent to the first inverting portion, opposite to the descending portion;
the second inverting portion being positioned adjacent to the ascending portion, opposite to the dipping portion;
the exiting portion being positioned adjacent to the second inverting portion, opposite to the ascending portion.

3. The automatic wax dipping system as claimed in claim 2, wherein the specific lengthwise section being the dipping portion and the ascending portion.

4. The automatic wax dipping system as claimed in claim 2 comprising:
the descending portion traversing into an opening of the second receptacle;
the dipping portion traversing across the opening of the second receptacle; and
the ascending portion traversing out of the opening of the second receptacle.

5. The automatic wax dipping system as claimed in claim 2 comprising:
a drip-catching trough;
the drip-catching trough being connected adjacent to the second receptacle; and
the drip-catching trough being positioned offset and along the ascending portion.

6. The automatic wax dipping system as claimed in claim 2 comprising:
a cooling mechanism;
the cooling mechanism being mounted adjacent and offset from the plurality of rails; and
the cooling mechanism being in thermal communication with second inverting portion and the exiting portion.

7. The automatic wax dipping system as claimed in claim 1 comprising:
a wax-refilling trough;
the wax-refilling trough being connected adjacent to the second receptacle; and
the wax-refilling trough being peripherally positioned to an opening of the second receptacle.

8. The automatic wax dipping system as claimed in claim 7 comprising:
a second set of heating elements;
the second set of heating elements being mounted adjacent to the second receptacle; and
the second set of heating elements being in thermal communication with the wax-refilling trough.

9. The automatic wax dipping system as claimed in claim 1 comprising:
a plurality of legs;
the plurality of legs being positioned external to the basin;
the plurality of legs being connected normal to a base of the basin; and
the plurality of legs being peripherally positioned about the base of the basin.

10. The automatic wax dipping system as claimed in claim 1 comprising:
a thermally-insulative layer; and
the thermally-insulative layer being superimposed onto an internal surface of the basin.

11. The automatic wax dipping system as claimed in claim 1 comprising:
a temperature-measuring gauge; and
the temperature-measuring gauge being in thermal communication with the first receptacle.

12. An automatic wax dipping system comprising:
a basin;
a first receptacle;
a second receptacle;
a first set of heating elements;
a track mechanism;
a motorized belt;
a quantity of liquid wax;
the track mechanism comprising a plurality of rails and an at least one motorized belt;
the plurality of rails comprising at least one first rail and at least one second rail;
each of the plurality of rails comprising a dipping portion, a descending portion, an ascending portion, a first inverting portion, a second inverting portion, an entering portion, and an exiting portion;
the first receptacle and the first set of heating elements being mounted within the basin;
the first set of heating elements being in thermal communication with the first receptacle;
the second receptacle being mounted within the first receptacle;
the quantity of liquid wax being accommodated within the second receptacle;

the plurality of rails being mounted adjacent to the basin;

the plurality of rails being suspended across an opening of the basin;

the at least one first rail and the at least one second rail being parallel and offset to each other;

the at least one motorized belt being operatively integrated into a specific lengthwise section of the plurality of rails;

the descending portion being positioned adjacent to the dipping portion;

the ascending portion being positioned adjacent to the dipping portion, opposite to the descending portion;

the first inverting portion being positioned adjacent to the descending portion, opposite to the dipping portion;

the entering portion being positioned adjacent to the first inverting portion, opposite to the descending portion;

the second inverting portion being positioned adjacent to the ascending portion, opposite to the dipping portion; and the exiting portion being positioned adjacent to the second inverting portion, opposite to the ascending portion.

13. The automatic wax dipping system as claimed in claim 12, wherein the specific lengthwise section being the dipping portion and the ascending portion.

14. The automatic wax dipping system as claimed in claim 12 comprising:

the descending portion traversing into an opening of the second receptacle;

the dipping portion traversing across the opening of the second receptacle; and the ascending portion traversing out of the opening of the second receptacle.

15. The automatic wax dipping system as claimed in claim 12 comprising:

a drip-catching trough;

the drip-catching trough being connected adjacent to the second receptacle; and the drip-catching trough being positioned offset and along the ascending portion.

16. The automatic wax dipping system as claimed in claim 12 comprising:

a wax-refilling trough;

a second set of heating elements;

the wax-refilling trough being connected adjacent to the second receptacle;

the wax-refilling trough being peripherally positioned to an opening of the second receptacle;

the second set of heating elements being mounted adjacent to the second receptacle; and the second set of heating elements being in thermal communication with the wax-refilling trough.

17. The automatic wax dipping system as claimed in claim 12 comprising:

a cooling mechanism;

the cooling mechanism being mounted adjacent and offset from the plurality of rails; and the cooling mechanism being in thermal communication with second inverting portion and the exiting portion.

18. The automatic wax dipping system as claimed in claim 12 comprising:

a plurality of legs;

the plurality of legs being positioned external to the basin;

the plurality of legs being connected normal to a base of the basin; and the plurality of legs being peripherally positioned about the base of the basin.

19. The automatic wax dipping system as claimed in claim 12 comprising:

a thermally-insulative layer; and the thermally-insulative layer being superimposed onto an internal surface of the basin.

20. The automatic wax dipping system as claimed in claim 12 comprising:

a temperature-measuring gauge; and the temperature-measuring gauge being in thermal communication with the first receptacle.

* * * * *